United States Patent [19]

Hasegawa et al.

[11] 4,122,422

[45] Oct. 24, 1978

[54] DEFLECTION DEVICE FOR USE WITH IN-LINE TYPE COLOR CATHODE RAY TUBES

[75] Inventors: Yoshikazu Hasegawa, Tokyo; Yasuyuki Ohmichi, Yokohama; Koichi Sakai, Tokyo, all of Japan

[73] Assignee: Sony Corporation, Tokyo, Japan

[21] Appl. No.: 762,766

[22] Filed: Jan. 26, 1977

[30] Foreign Application Priority Data

Jan. 26, 1976 [JP] Japan ..... 51/7357

[51] Int. Cl.[2] ..... H01F 5/00

[52] U.S. Cl. ..... 335/213; 335/210

[58] Field of Search ..... 335/213, 210, 212

[56] References Cited

U.S. PATENT DOCUMENTS 4,041,428 8/1977 Kikuchi et al. ..... 335/213

*Primary Examiner*—Harold Broome

*Attorney, Agent, or Firm*—Lewis H. Eslinger

[57] ABSTRACT

In a deflection yoke for use with an in-line color cathode ray tube in which a plurality of electron beams originating in a common plane, for example, a horizontal plane, within a tube envelope are directed forwardly along paths converging through the deflection yoke to impinge on a screen at the front of the tube envelope, and in which the deflection yoke is made up of vertical and horizontal deflection windings for producing magnetic fields by which the electron beams are deflected in vertical and horizontal directions, each of the vertical and horizontal deflection windings is of saddle form so as to have side portions connected by bent front and back end portions, the vertical deflection winding is disposed against the tube envelope and has its bent back end portion shaped to closely conform to the surface of the tube envelope, the horizontal deflection winding is disposed outside of the vertical deflection winding, and the bent back end portion of the vertical deflection winding is closer to the screen at the front of the picture tube than the bent back end portion of the horizontal deflection winding. Furthermore, the vertical and horizontal deflection windings are preferably arranged to produce barrel-type and pincushion type magnetic fields, respectively, and a toroidal magnetic core extends around the horizontal deflection winding. The use of the foregoing deflection yoke with an in-line color cathode ray tube makes it possible to eliminate or at least substantially simplify the usual dynamic convergence correcting device usually associated with the latter.

6 Claims, 16 Drawing Figures

DEFLECTION DEVICE FOR USE WITH IN-LINE TYPE COLOR CATHODE RAY TUBES

BACKGROUND OF THE INVENTION

1. Field of the invention

This invention relates generally to a deflection yoke for use with a color cathode ray tube so as to effect the scanning deflections of the electron beams generated therein, and more particularly is directed to a deflection yoke, as aforesaid, which is intended for use with an in-line color cathode ray tube, that is, a tube in which the plural electron beams originate in a common plane within the tube envelope.

2. Description of the Prior Art

Color cathode ray tubes or the so-called in-line type, that is, in which a plurality of electron beams originate in a common plane, for example, a horizontal plane, are now frequently employed, for example, in color television receivers and the like. In order to cause the electron beams to scan the screen of the color cathode ray tube, color cathode ray tubes of the in-line type are provided with a deflection yoke composed of a horizontal deflection winding producing a horizontal magnetic field of the pincushion type and a vertical deflection winding producing a vertical magnetic field of the barrel type for minimizing misconvergence of the electron beams. In most existing in-line color cathode ray tubes, a saddle shaped horizontal deflection winding and a toroidal vertical deflection winding are employed. However, the production of the deflection windings is substantially facilitated when both the horizontal and vertical deflection windings are saddle shaped.

Although saddle shaped horizontal and vertical deflection windings have been used in the deflection yoke for an in-line color cathode ray tube, and such deflection windings have been arranged to provide a horizontal deflection field of the pin-cushion type and a vertical deflection field of the barrel type, the resulting deflection yoke still causes misconvergence of the electron beams, particularly at the peripheral portions of the screen of the color cathode ray tube. In order to avoid such misconvergence, it has been the usual practice to employ a dynamic convergence correcting device in addition to the deflection yoke. However, such a dynamic convergence correcting device is troublesome to adjust and/or control and further results in increased cost of the color cathode ray tube.

In order to avoid the necessity for providing a dynamic convergence correcting device, it has also been proposed to provide an in-line color cathode ray tube with a deflection yoke in which the horizontal and vertical deflection windings are both toroidal and have specially arranged winding distributions by which the described misconvergence is eliminated. However, it is difficult to produce toroidal horizontal and vertical deflection windings with the required special distribution of the windings therein.

OBJECTS AND SUMMARY OF THE INVENTION

Accordingly, it is an object of the present invention to provide a deflection yoke for an in-line color cathode ray tube which avoids the above described disadvantages of the existing deflection yokes.

More specifically, it is an object of the invention to provide a deflection yoke for use with an in-line color cathode ray tube, in which the horizontal and vertical deflection windings of the yoke are both saddle-shaped for ease of production, and the horizontal and vertical deflection windings are arranged in respect to each other so as to substantially avoid misconvergence of the electron beams at the screen of the color cathode ray tube.

A further object is to provide a deflection yoke for use with an in-line color cathode ray tube, as aforesaid, which eliminates the necessity of providing the color cathode ray tube with a dynamic convergence correcting device.

In accordance with an aspect of this invention, in a deflection yoke for use with an in-line color cathode ray tube in which a plurality of electron beams originating in a common plane within a tube envelope are directed forwardly along converging paths through the deflection yoke to impinge on a screen at the front of the tube envelope, and in which the deflection yoke comprises first and second deflection windings for producing magnetic fields by which the electron beams are deflected in respective directions at right angles and parallel to the common plane in which the beams originate; each of the first and second deflection windings is of saddle form or shape so as to have side portions connected by bent front and back end portions, the first deflection winding is disposed against the tube envelope and has its bent back end portion shaped to closely conform to the surface of the tube envelope, the second deflection winding is disposed outside of the first deflection winding, and the bent back end portion of the first deflection winding is closer to the screen at the front of the picture tube than the bent back end portion of the second deflection winding.

The above, and other objects, features and advantages of the invention, will be apparent in the following detailed description of an illustrative embodiment of the invention which is to be read in connection with the accompanying drawings.

DETAILED DESCRIPTION OF A PREFERRED EMBODIMENT

Figure 1:
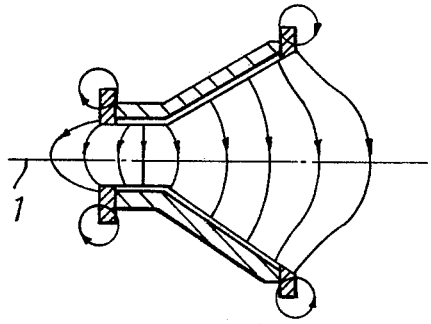
FIG. 1 PRIOR ART
FIG. 1 is a schematic diagram illustrating one of the deflection fields produced by a prior art deflection yoke.

In in-line color cathode ray tubes of the type to which this invention generally relates, red, green and blue electron beams originate in a common horizontal plane within the tube envelope and are directed forwardly along paths that converge in passing through a deflection yoke so as to impinge on a screen at the front of the tube envelope. It has been proposed that the deflection yoke for the foregoing type of color cathode ray tube should have its horizontal and vertical deflection windings both wound in a saddle form or shape, with such deflection windings being arranged to provide a horizontal deflection magnetic field of pincushion type and a vertical deflection magnetic field of barrel type. When the horizontal and vertical deflection windings are of saddle shape, each of the respective magnetic deflection fields has the configuration shown on FIG. 1 which is a cross-sectional view taken in a plane extending through the longitudinal axis of the cathode ray tube, with the right-hand side of FIG. 1 facing in the direction toward the screen.

Figure 2:
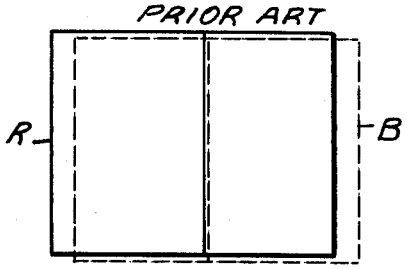
FIG. 2 PRIOR ART
FIG. 2 is a schematic diagram illustrating the misconvergence encountered with the prior art deflection yoke of FIG. 1.

When the above described deflection yoke is employed with an in-line color cathode ray tube, the misconvergence illustrated on FIG. 2 results therefrom, that is, as the opposite side edges of the picture screen are neared, the landing points or spots of the electron beams on the screen are increasingly spaced apart. In order to eliminate such misconvergence, as shown on FIG. 3, it has been usual in the prior art to employ an additional misconvergence correcting device to which there is applied a parabolic signal at the horizontal scanning frequency.

In a color cathode ray tube of the type employing a single electron gun for producing the three electron beams, for example, as disclosed in U.S. Pat. No. 3,448,316 and the corresponding U.S. Pat. No. Re 27,751, having a common assignee herewith, the three electron beams are directed so as to intersect each other substantially at the optical center of a common main focussing lens with the result that the beams diverge on exiting from such main focussing lens. In such color cathode ray tube, the diverging beams pass between electrostatic deflection plates so as to be made to converge again at the screen of the color cathode ray tube and, in such device, the previously described misconvergence is corrected by superimposing a parabolic voltage on the D.C. voltage applied to the electrostatic deflection plates. As previously mentioned, the purpose of the present invention is to eliminate the misconvergence of the beams by the construction and arrangement of the deflection yoke itself, so as to make unnecessary any additional convergence correcting device.

Figure 4:
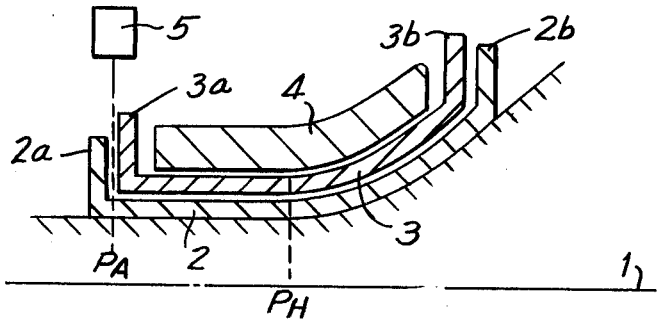
FIG. 4 PRIOR ART
FIG. 4 is a schematic cross-sectional view of a prior art deflection yoke employing horizontal and vertical deflection windings which are both saddle shaped.

Referring now to FIG. 4, it will be seen that, in a prior art deflection yoke, a horizontal deflection winding 2 is wound in a saddle shape and is mounted on the tube envelope of a cathode ray tube having its longitudinal axis indicated at 1 between the neck and funnel portions of the tube envelope. The deflection yoke of FIG. 4 is further shown to include a vertical deflection winding 3 which is also wound in a saddle shape and is located around the horizontal deflection winding 2, and a toroidal core 4 which, in turn, extends around the vertical deflection winding 3. Since the horizontal and vertical deflection windings 2 and 3 are both of saddle shape, each of such windings includes side portions connected by bent back and front end portions. More particularly, in the prior art deflection yoke of FIG. 4, the bent back and front end portions 3*a* and 3*b* of the vertical deflection winding 3 are shown to be located near to the bent back and front end portions 2*a* and 2*b*, respectively, of the horizontal deflection winding 2. In the case of the prior art deflection yoke shown on FIG. 4, the magnetic field distributions in the direction of the tube axis 1 are selected so that the maximum strength of the horizontal deflection magnetic field $H_H$ and the maximum strength of the vertical deflection magnetic field $H_V$ are located at substantially the same position $P_h$, while, at the position $P_A$ at the entry end of the deflection yoke, that is, adjacent the inner side of the bent back end portion 2*a* of the horizontal deflection winding 2, the strength of the vertical deflection magnetic field $H_V$ is at least equal to or even slightly larger than the strength of the horizontal deflection magnetic field $H_H$. Therefore, as indicated by the rectangular shape 5 on FIG. 4, at the entry position $P_A$, the deflection width of the beam in the vertical direction is at least equal to or even slightly greater than the deflection width of the beam in the horizontal direction.

Figure 5:
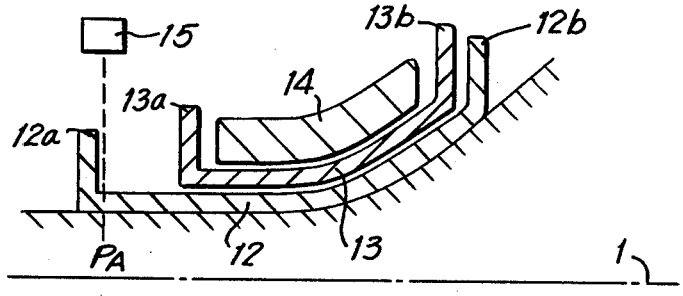
FIG. 5 is a view similar to that of FIG. 4, but showing a deflection yoke developed by the present inventors and which has not been published or made public prior to this application.

Referring now to FIG. 5, it will be seen that, in a deflection yoke developed by the present inventors, and having a saddle-shaped horizontal deflection winding 12 mounted on the cathode ray tube envelope, a saddle-shaped vertical deflection winding provided on the horizontal deflection winding 12 and a toroidal magnetic core 14 extending around the vertical deflection winding 13, the vertical deflection winding 13 is substantially shorter in the direction of the tube axis 1 than the horizontal deflection winding 12. Thus, with the bent front end portions 12*b* and 13*b* of the horizontal and vertical deflection windings 12 and 13 being located close to each other, the bent back end portion 13*a* of the vertical deflection winding 13 is spaced substantially in the forward direction from the bent back end portions 12*a* of the horizontal deflection winding 12.

Figure 6:
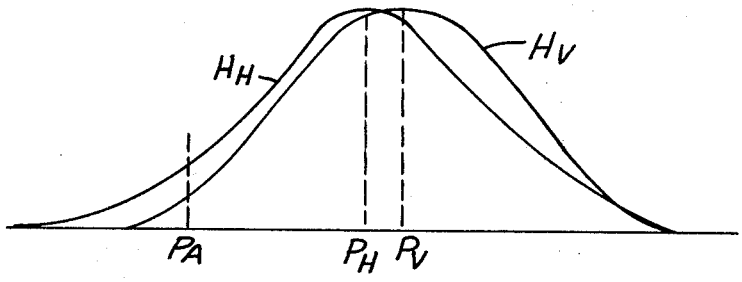
FIG. 6 is a graph illustrating the distribution of the horizontal and vertical deflection fields along the cathode ray tube axis for the deflection yoke shown on FIG. 5.
Figure 7:
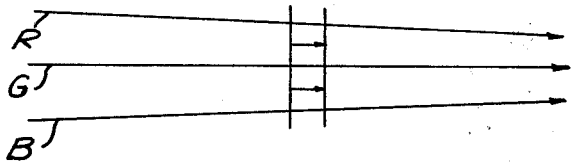
FIG. 7 is a schematic diagram illustrating the converging paths along which the electron beams pass through the deflection yoke of FIG. 5.
Figure 8:
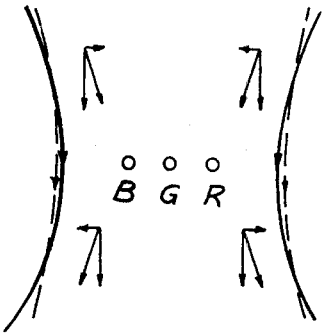
FIGS. 8 to 13 are schematic diagrams to which reference will be made in explaining the manner in which misconvergence of the electron beams is eliminated by the deflection yoke of FIG. 5 and the improvement thereover constituting the present invention.
Figure 9:
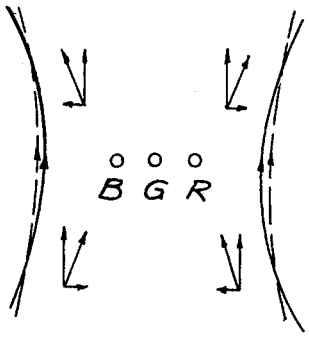
Figure 10:
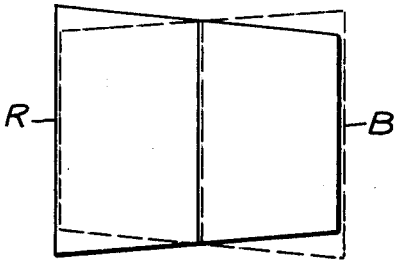
Figure 11:
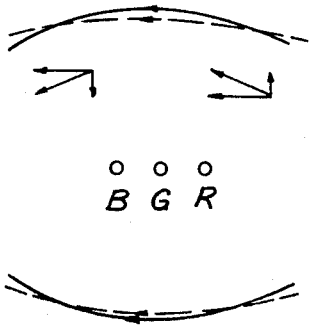
Figure 12:
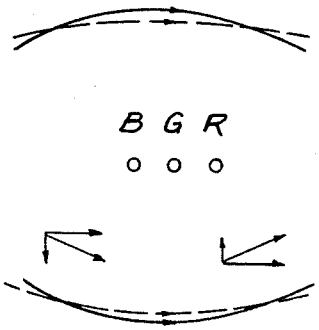

By reason of the arrangement described above with respect to FIG. 5, the magnetic field distribution in the direction of the tube axis is as shown on FIG. 6, that is, the maximum strength $P_V$ of the vertical deflection field $H_V$ is located closer to the screen than the position of the maximum strength $P_H$ of the horizontal deflection field $H_H$. Thus, the vertical deflection field $H_V$, as a whole, acts on the electron beams R, G and B at a position which is closer to the screen, where the distances between the electron beams are reduced, as compared with the position at which the horizontal deflection field $H_H$, as a whole, may be considered to act on the electron beams, as shown on FIG. 7. Furthermore, with the arrangement shown on FIG. 5, at the entry position $P_A$, that is, at the location of the bent back end portion 12*a* of the horizontal deflection winding 12, the horizontal deflection field $H_H$ is greater than the vertical deflection field $H_V$ (FIG. 6). As a result of the foregoing, and as indicated by the rectangular shape 15 on FIG. 5, the deflection width of each beam in the horizontal direction is greater than the deflection width of the beam in the vertical direction at the position $P_A$. Furthermore, in the deflection yoke previously developed by the present inventors and described above with reference to FIG. 5, the degree of pincushion shape given to the horizontal deflection field $H_H$ generated by the horizontal deflection winding 12 and the degree of barrel shape given to the vertical deflection field $H_V$ generated by the vertical deflection winding 13 are relatively larger than the pincushion and barrel shapes given to the horizontal and vertical deflection fields in deflection yokes of the prior art, for example, as illustrated on FIG. 4. If the degree of pincushion provided for the horizontal deflection field of the prior art deflection yoke shown on FIG. 4 is increased, for example, if the horizontal deflection field is changed from the slightly pincushion shape indicated by broken lines on FIGS. 8 and 9 to the more pronounced pincushion shape indicated by the solid lines on FIGS. 8 and 9 when the beams B, G and R scan the left and right-hand portions, respectively, of the screen, the field exerted on the side beams B and R has its vertical component decreased while its horizontal component is increased. By reason of the foregoing, although misconvergence in the horizontal direction, as shown on FIG. 2, is corrected by reason of the increased degrees of pincushion and barrel, a cross misconvergence in the vertical direction is produced, as indicated on FIG. 10. Further, if the prior art deflection yoke of FIG. 4 has its vertical deflection winding arranged to provide a vertical deflection field of increased barrel shape or degree, that is, if the vertical deflection field is changed from the condition indicated in dotted lines on FIGS. 11 and 12 to the condition shown in full lines on FIGS. 11 and 12 when the beams scan the upper and lower halves of the screen, respectively, the field exerted on the side beams B and R has its horizontal component decreased but its vertical component is increased. As a result of the foregoing, although the cross misconvergence in the vertical direction shown on FIG. 10 is corrected by increasing the degree of barrel shape imparted to the vertical deflection field, there results a misconvergence in the horizontal direction at the top and bottom portions of the screen, as shown on FIG. 13. In other words, when the deflection yoke of FIG. 4 has its horizontal and vertical deflection windings arranged so as to increase the degrees of pincushion shape and barrel shape imparted to the horizontal and vertical deflection fields, respectively, a bow-shaped misconvergence in the horizontal direction results therefrom in that the landing positions of the red beam R are shifted excessively toward the right and the landing positions of the blue beam B are shifted excessively to the left at the upper and lower margins of the screen, as shown on FIG. 13.

Figure 13:
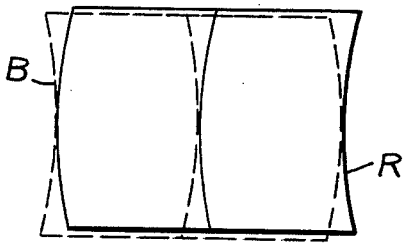

As distinguished from the foregoing, in the deflection yoke of FIG. 5, the degree of pincushion shape imparted to the horizontal deflection field and the degree of barrel shape imparted to the vertical deflection field can be both increased without encountering the misconvergence shown on FIG. 13. More particularly, since in the deflection yoke of FIG. 5 the vertical deflection field, as a whole, acts on the beam B, G and R at a position $P_V$ where the distances between the adjacent beams are smaller than at the position $P_H$ where the horizontal deflection field, as a whole, as previously described with reference to FIGS. 6 and 7, the vertical deflection field is not changed in magnitude but the deflection force thereof acting on the beams is decreased. By reason of the foregoing, when the degree of pincushion shape given to the horizontal deflection field and the degree of barrel shape given to the vertical deflection field in the deflection yoke of FIG. 5 are increased, the deflection force which deflects the beams B and R in opposite horizontal directions as the beams are directed toward the upper and lower edge portions of the screen is decreased. Further, the magnetic field distribution of the vertical deflection field $H_V$ in the direction of the tube axis is shifted suitably in respect to the magnetic field distribution of the horizontal deflection field $H_H$, as shown on FIG. 6, so that the correct convergence shown on FIG. 3 is achieved without the appearance of the bow misconvergence shown on FIG. 13.

However, when the deflection yoke is constructed as described above with reference to FIG. 5, there is a difference between the deflection efficiencies in the horizontal and vertical directions, that is, the deflection efficiency in the vertical direction is decreased relative to the deflection efficiency in the horizontal direction, and such disparity between the deflection efficiencies in the horizontal and vertical directions is not desirable.

Figure 15:
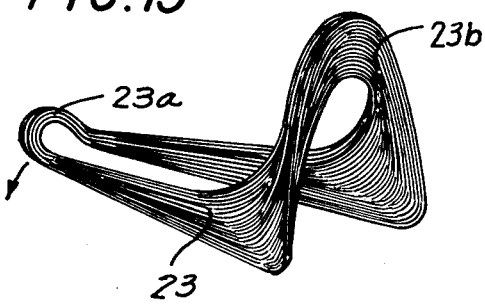
FIG. 15 is a perspective view of the vertical deflection winding included in the deflection yoke of FIG. 14.
Figure 14:
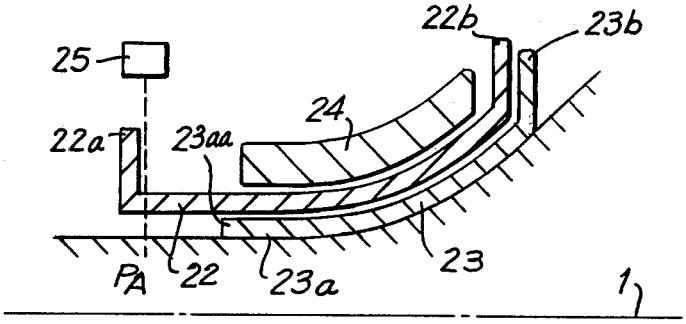
FIG. 14 is a sectional view similar to that of FIGS. 4 and 5, but illustrating an embodiment of the present invention.

In order to avoid the foregoing problem associated with the deflection yoke of FIG. 5, a deflection yoke according to the present invention, as illustrated on FIG. 14, comprises a vertical deflection winding 23 which is mounted on the outer surface of the cathode ray tube envelope, a horizontal deflection winding 22 located outside the vertical deflection winding 23, and a toroidal magnetic core 24 extending around the outside of the horizontal deflection winding 22. In the deflection yoke according to this invention, as shown on FIG. 14, both the horizontal and vertical deflection windings 22 and 23 are of saddle shape or form so as to be easily produced. Furthermore, as shown particularly on FIG. 15, the bent back end portion **23*a* of the vertical deflection winding 23 is curved or shaped so as to closely conform to the surface of the tube envelope, and, as shown on FIG. 14, the length of the vertical deflection winding 23 in the direction of the tube axis 1 is substantially shorter than the corresponding dimension of the horizontal deflection winding 22. Further, the bent front end portions 22*b* and 23*b* of the horizontal and vertical deflection windings 22 and 23 are located close to each other, with the result that the end 23*aa* of the bent back end portion 23*a* of vertical deflection winding 23 is spaced substantially, in the direction toward the screen, from the bent back end portion 22*a* of the horizontal deflection winding 22. As a result of the foregoing, the vertical deflection field of the yoke on FIG. 14, as a whole, acts on the electron beams at a position along the latter where the distances between the adjacent beams are smaller than such distances between the beams at the location where the horizontal deflection field may be considered, as a whole, to act on the beams, as was described above in connection with FIGS. 5, 6 and 7. Furthermore, at the entry position $P_A$, that is, at the inside of the bent back end portion 22*a* of horizontal deflection winding 22, the deflection width of the beam in the horizontal direction is larger than the deflection width of the beam in the vertical direction, as indicated by the rectangular shape 25 on FIG. 14. Moreover, the horizontal and vertical deflection windings 22 and 23** of the deflection yoke according to this invention are arranged so as to enhance the degrees of pincushion shape and barrel shape imparted to the horizontal and vertical deflection fields, respectively.

Figure 3:
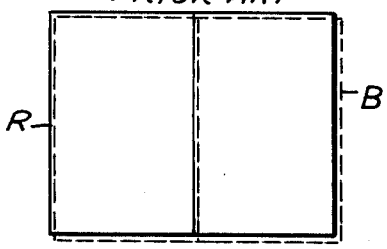
FIG. 3 PRIOR ART
FIG. 3 is a schematic diagram similar to that of FIG. 2, but illustrating the conditions when the misconvergence is corrected.

Experiments have established that, when the distance between the bent back end portion 22*a* of horizontal deflection winding 22 and the end 23*aa* of the bent back end portion 23*a* of the vertical deflection winding 23 is about 30% of the axial distance between the bent back and forward end portions 22*a* and 22*b* of horizontal deflection winding 22, the deflection width of the beam in the horizontal direction becomes sufficiently wider than the deflection width of the beam in the vertical direction at the position $P_A$ as to fully avoid the misconvergence and thereby provide the correct registration of the rasters of the three beams, as shown on FIG. 3.

Furthermore, in the deflection yoke according to this invention, as shown on FIG. 14, the location of the vertical deflection winding 23 inside of the horizontal deflection winding 22, that is, against the wall surface of the cathode ray tube envelope, serves to enhance the deflection efficiency in the vertical direction and thereby remove the difference between the horizontal and vertical deflection efficiencies which were mentioned above with reference to the deflection yoke of FIG. 5, and which results from the differences in the lengths of the horizontal and vertical deflection windings 22 and 23.

Figure 16:
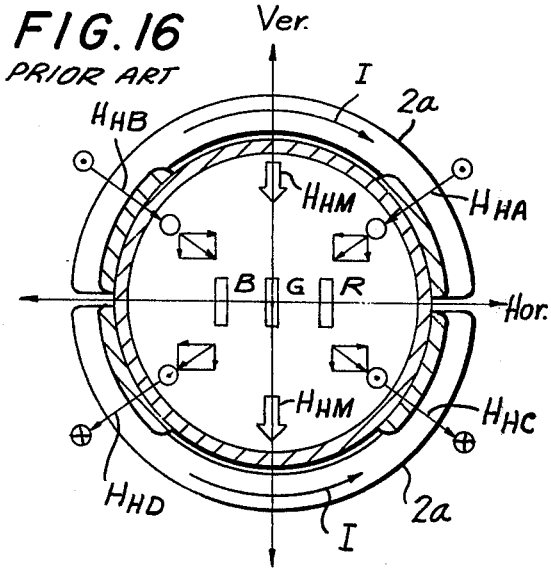
FIG. 16 PRIOR ART
FIG. 16 is a schematic diagram to which reference will be made in explaining a phenomenon which causes misconvergence in the prior art deflection yokes.

Further, since the deflection width of each beam in the vertical direction is smaller than that in the horizontal direction at the position $P_A$ of the bent back end portion 22*a* of the horizontal deflection winding 22 in the deflection yoke according to this invention, an undesirable influence of such bent back end portion 22*a* on the horizontal deflection field and on the deflection of the beams thereby can be reduced. Such undesirable influence will be described with reference to FIG. 16 which illustrates the horizontal deflection magnetic fields generated by the horizontal deflection winding 2 of the prior art deflection yoke of FIG. 4 at the position $P_A$ of its bent back end portion 2*a*, as viewed from the screen. As is shown on FIG. 16, a main magnetic field $H_{HM}$ in the vertical direction is generated by the current flowing through the side portions of the saddle-shaped horizontal deflection winding, and the beams are deflected in the horizontal direction by the field $H_{HM}$. Further, a current I flowing through each bent back end portion 2*a* produces a field which surrounds the respective bent back end portion 2*a*. This last mentioned magnetic field results in magnetic fields $H_{HA}$ and $H_{HB}$ which are directed radially inward toward the tube axis and magnetic fields $H_{HC}$ and $H_{HD}$ which are directed radially outward away from the tube axis at the position $P_A$. These fields $H_{HA}$-$H_{HD}$ cancel one another with respect to the central beam G and have no influence upon the latter. However, if the deflection widths of the beams R and B are relatively large in the vertical direction, as shown on FIG. 16, the side beams R and B are affected by the fields $H_{HA}$-$H_{HD}$. In other words, the fields $H_{HA}$-$H_{HD}$ can be broken down into vertical and horizontal components, with such vertical components being absorbed by the main field $H_{HM}$. However, as is apparent from FIG. 16, the horizontal components give rise to forces acting in opposite directions on the side beams R and B when the latter scan the lower and upper half portions of the screen, with the forces applied to the beams R and B being opposite in direction. It is the foregoing forces which act to cause the cross misconvergence in the vertical direction shown on FIG. 10.

However, since, in the deflection yoke according to this invention, the deflection width of the beam in the vertical direction is relatively small at the location $P_A$ of the bent back end portion 22*a* of the horizontal deflection winding 22, the field components in the horizontal direction have almost no effect on the beams and, hence, do not act to cause cross misconvergence in the vertical direction.

In view of the foregoing, misconvergence of the plural electron beams can be avoided without the necessity of providing a separate or additional convergence correcting device, and without lowering the deflection efficiency, particularly in the vertical direction.

Although an illustrative embodiment of the invention has been described in detail herein with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. In a deflection yoke for use with an in-line color cathode ray tube in which a plurality of electron beams originating in a common plane within a tube envelope are directed forwardly along converging paths through the deflection yoke to impinge on a screen at the front of the tube envelope, said deflection yoke comprising first and second deflection windings for producing magnetic fields by which the electron beams are deflected in respective directions at right angles and parallel to said common plane in which the beams originate; the improvement of each of said first and second deflection windings being of saddle form so as to have side portions connected by bent front and back end portions, said first deflection winding being disposed against the tube envelope and having its bent back end portion shaped to closely conform to the surface of the tube envelope, said second deflection winding being disposed outside of said first deflection winding, and said bent back end portion of said first deflection winding being spaced apart from, and closer to the screen at the front of the tube than, the bent back end portion of the second deflection winding.

2. A deflection yoke according to claim 1; further comprising a toroidal magnetic core extending around said second deflection winding.

3. A deflection yoke according to claim 2; in which said common plane in which the beams originate is horizontal, and said first and second deflection windings respectively deflect said beams in the vertical and horizontal directions.

4. A deflection yoke according to claim 3; in which said first deflection winding is arranged to produce a barrel type magnetic field, and said second deflection winding is arranged to produce a pincushion type magnetic field.

5. A deflection yoke according to claim 4; in which said bent front end portions of said first and second deflection windings are close to each other, and in which the distance between said bent back end portions of the first and second deflection windings is approximately 30% of the distance between said bent back and front end portions of said second deflection winding.

6. A deflection yoke according to claim 5; in which said first and second deflection windings produce a composite magnetic field by which the deflection width of the electron beams in the region of said back end of the second deflection winding is greater in the horizontal direction than in the vertical direction.

* * * * *